US005725053A

United States Patent [19]

Weber

[11] Patent Number: 5,725,053

[45] Date of Patent: Mar. 10, 1998

[54] PUMP ROTOR PLACER

[76] Inventor: James L. Weber, 707, 1100 - 8th Avenue S.W., Calgary, Alberta, Canada, T2P 3T9

[21] Appl. No.: 700,310

[22] Filed: Aug. 12, 1996

[51] Int. Cl.[6] ..... E21B 43/00

[52] U.S. Cl. ..... 166/105

[58] Field of Search ..... 166/105, 68.5, 166/369, 242.1; 418/48

[56] References Cited

U.S. PATENT DOCUMENTS

| | | | |
|---|---|---|---|
| 2,456,227 | 12/1948 | Wade | 418/48 |
| 2,946,387 | 7/1960 | Hooker, Jr. | 166/105 |
| 4,580,955 | 4/1986 | Karge | 418/48 |
| 5,209,294 | 5/1993 | Weber | 166/105 |

*Primary Examiner*—Hoang C. Dang
*Attorney, Agent, or Firm*—Sheridan Ross, P.C.

[57] ABSTRACT

A rotor placer is located within an oil well for stabilizing the rotor of a progressive cavity pump. A tubular housing is connected between the production string and pump stator. A driveshaft is installable within the housing and is connected between the rod string and the pump rotor. The driveshaft latches into a cylindrical sleeve installed concentrically within the housing. The housing is distended outwardly to accept the sleeve which has a bore similar to that of the production tubing. Bearings are interposed in the annulus between the sleeve and housing for concentrically and axially stabilizing the rod string. The sleeve is sealed against the housing to protect the bearings. A passageway is formed in the driveshaft to bypass pumped well fluids around the bearings. The driveshaft-to-sleeve latch comprises a plurality of axially-extending and interconnected slots formed in the inside wall of the sleeve and radially outward biased pins extending from the driveshaft. Every second hole locks the pin within the slots, and every alternate hole contains wedges for displacing the pins radially inwards and thereby disengaging the pins from the slots so that the driveshaft is released from the sleeve.

5 Claims, 5 Drawing Sheets

FIG. 3A.
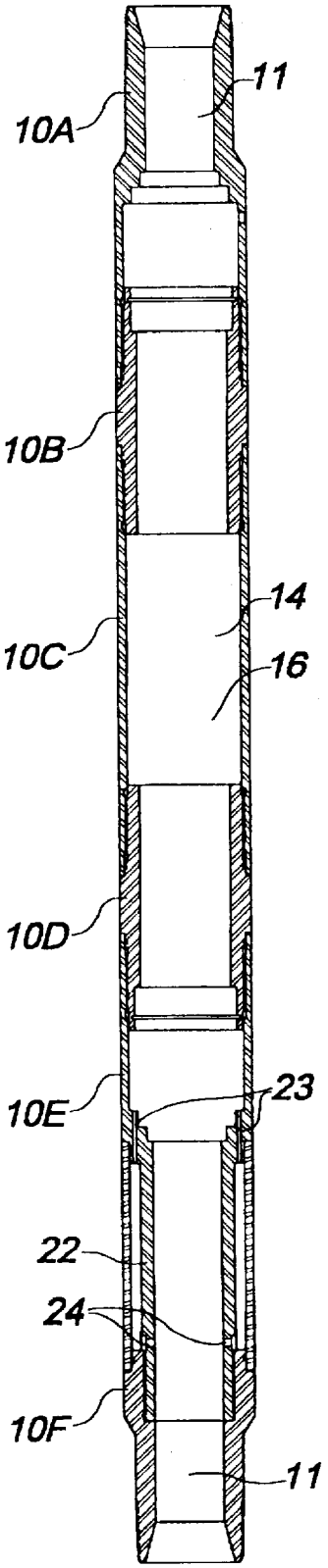
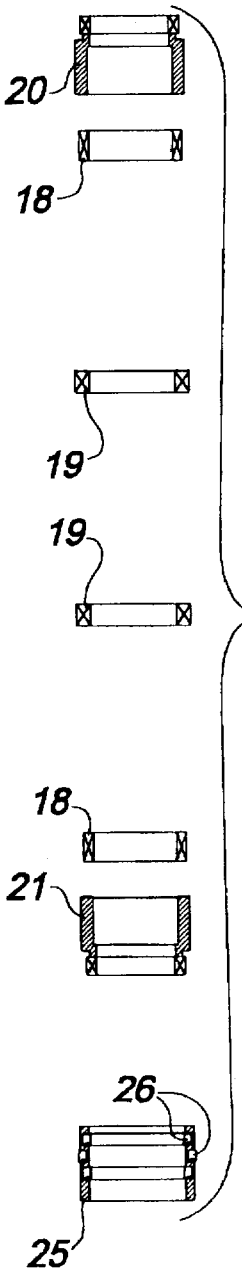
FIG. 3B.
FIG. 3C.
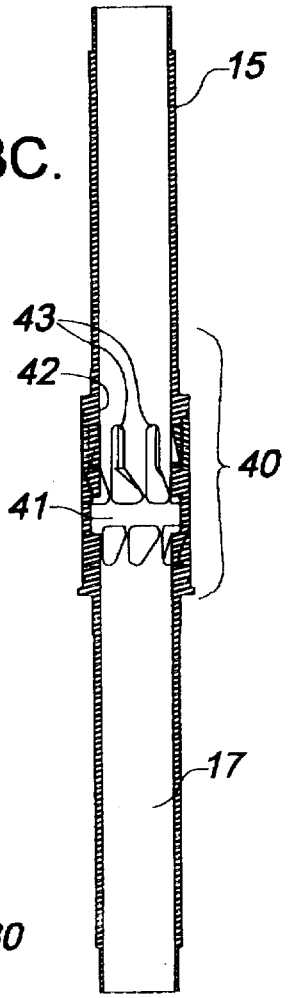
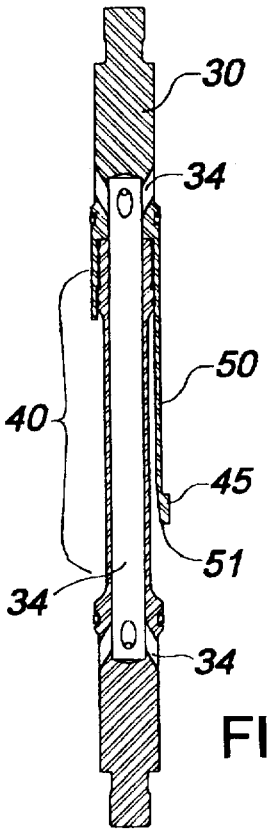
FIG. 3D.

FIG. 9.
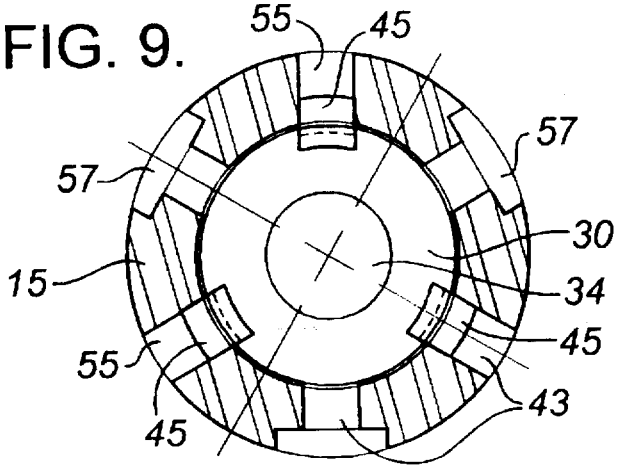
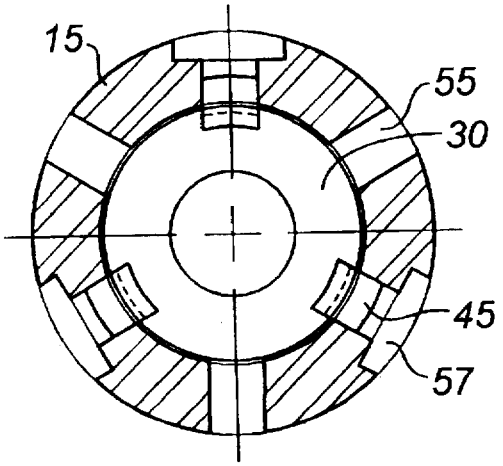
FIG. 10.
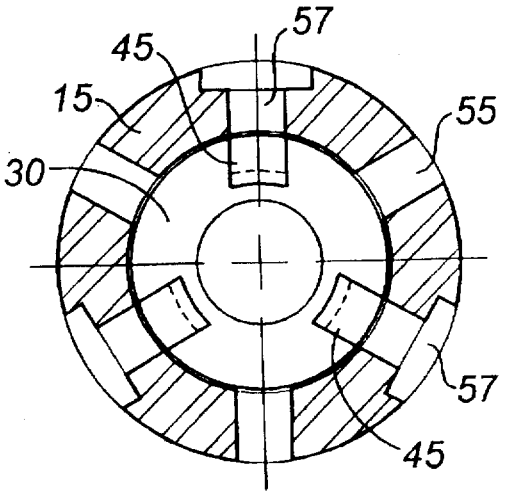
FIG. 11.

PUMP ROTOR PLACER

FIELD OF THE INVENTION

The present invention relates to apparatus for stabilizing a rotating rod string used for driving the rotor of a progressive cavity pump located in an oil well.

BACKGROUND OF THE INVENTION

A progressive cavity pump is located within an oil well, positioned at the bottom end of a production string which extends down the bore of the well. The pump forces fluids up the bore of the production string to the surface. The pump comprises a pump stator coupled to the production tubing string, and a rotor which is both suspended and rotationally driven by a sucker rod string extending through the production string bore.

The rotor is a helical element which rotates within a corresponding helical passage in the stator. Characteristically, the rotor does not rotate concentrically within the stator but instead scribes a circular or elliptical path. This in turn causes the sucker rod to oscillate, sometimes wildly, within the bore of the production string, potentially damaging the rod or production string.

A device for restraining the non-concentric motion of the sucker rod is disclosed in U.S. Pat. No. 5,209,294, issued May 11, 1993 to J. Weber, the applicant. While this reference is hereby incorporated by reference, it is useful to briefly describe the preferred embodiment of the device, referred to as a "Rotor Placer."

In the prior art reference, the rotor placer comprises a tubular housing inserted at the bottom of the production string, just above the progressive cavity pump. A drive shaft is secured to the bottom of the sucker rod string, between the string and the rotor. The housing has walls and a bore forming a bearing seat. Flow passages are formed in the walls around the seat. As the pump stator and rotor are independently suspended from the production and sucker rod strings respectively, the stator and rotor can be vertically mis-aligned. Thus, the driveshaft is both vertically constrained and laterally stabilized using a thrust bearing, mounted to the upper end of the driveshaft, which seats in the bore of the tubular housing.

The bearing has an outer diameter sufficiently small to be removably installable down the bore of the production string, along with the driveshaft and rotor. Pumped fluids pass radially outboard of the thrust bearing through the flow passages for production up the bore of the production string.

Unfortunately, by providing a bearing and associated bearing seals which are installable down the bore of the production tubing, the bearing diameter is overly restricted, reducing its load carrying capability and leading to reduced service life.

Further, in order to retrieve the rotor and rod string once placed, the bearing is formed with an external annular ring which engages a cooperating collet mounted to the tubular housing. The collet releases the driveshaft upon an upward pull on the rod string of about 5000 lbs. greater than the string weight. The annular space consumed by the collet arrangement further restricts the maximal diameter of the bearing, further decreasing the bearing's service loading.

Accordingly there is a need for an improved arrangement; one which accommodates a stabilizing bearing having a larger diameter for increased load carrying capability and improved performance.

SUMMARY OF THE INVENTION

As disclosed in U.S. Pat. No. 5,209,294, issue to applicant and described above, it is known to provide a down-hole tubing housing and then lower a driveshaft (with pump rotor) upon which is mounted a sealed bearing for mating with the tubular housing. By limiting the bearing diameter to one which fits down the production tubing, the bearings of the prior art rotor placer were undersized for the loads imposed and were prone to early failure.

The solution to providing a larger bearing is to abandon any attempt to install the bearing through the bore of the production string and instead locate it within the tubular housing and install it with the production string. Thus the bearing is no longer restricted to a diameter less than that of the bore of the production tubing. Accordingly in a preferred aspect of the invention, the internal bore of the tubing housing is increased in diameter to accommodate larger bearings. By providing a concentric sleeve within the housing, an annular space is formed therebetween, within which a plurality of bearings reside. The annular space is sealed from the well fluids and is preferably fitted with a device for equalizing the pressure across the seals.

In a broad aspect then, an improved rotor placer is located within an oil well in which a sucker rod string extends down the bore of production tubing and is drivably connected to the rotor of a progressive cavity pump, the stator which is connected to the bottom of the production string, and in which a tubular housing is connected between the production string and stator, a driveshaft installable within the housing and connected between the rod string and the rotor, and bearings interposed between the driveshaft and housing for concentrically and axially stabilizing the rod string, the improvement comprising:

- a sleeve having a cylindrical wall and forming a bore for accepting the driveshaft, the axial length of the sleeve being shorter than the tubular housing,
- a tubular housing assembled from at least two parts and having radially distended walls for forming a bore intermediate its ends which is large enough in diameter to accept the sleeve positioned concentrically therein and forming an annular space therebetween;
- bearing means located in the annular space for concentrically, axially and rotatably positioning the sleeve, preferably having seals to exclude well fluids, and more preferably having means for equalizing the pressure between the annular space and the well itself;
- means for connecting the housing parts once the bearings and sleeve have been installed therein;
- passageways formed in the driveshaft for conducting fluids past the bearing means and on up to the production string; and
- means for releasably latching the driveshaft and sleeve together so that the sleeve is locked concentrically and axially to the driveshaft.

In another aspect of the invention, the preferred latching means unequivocally provides either of two latched conditions: locked—regardless of axial loading of the rod string; or released—by applying very little load above that of the weight of the rod string. More particularly, the latching means comprises:

- a plurality of parallel and axially extending slots formed in the wall of the bore of the sleeve;
- a plurality of slot-following pins, extending radially from the driveshaft and movable between a radially inward bore-clearing position and a radially outward slot-engaging position, the number of pins being one-half that of the slots and arranged to engage only every alternate slot;

means, associated with the down-hole end of the slots for relatively guiding the pins from one slot to the adjacent slot in a progressively circumferential manner and preventing the pins from disengaging from the slots;

means associated with the up-hole end of every second slot for arresting up-hole axial travel of the pins in those slots and thereby locking the pin in the slot; and means associated with the up-hole end of the alternate slots for displacing the pins radially inwards and thereby disengaging the pins from the slots so that the driveshaft is released from the sleeve.

BRIEF DESCRIPTION OF THE DRAWINGS

FIG. 1*a* illustrates a sucker rod string, driveshaft and pump rotor, the rotor being connected to the driveshaft with a length of sucker rod;

FIG. 1*b* illustrates the tubular housing of the present invention (actual housing component lengths have been shortened from those shown in FIG. 1, for illustrative purposes) installed in a well casing and connected to a pump stator and stator no-turn tool;

FIGS. 3*a*–3*d* illustrate an exploded cross-sectional view of the tubular housing, bearings, seals, sleeve and driveshaft. More specifically:

FIG. 3*a* is a cross-sectional view of the tubular housing illustrating, in assembled form, all of the components which enable installation of seals, bearings and the sleeve;

FIG. 3*b* is a cross-sectional view of the bearings and bearings seals, arranged axially as they would be spaced and installed according to FIG. 3*a;*

FIG. 3*c* is a cross-sectional view of the sleeve, arranged as it would be installed in the tubular housing according to FIG. 3*a;*

FIG. 3*d* is a cross-sectional view of the driveshaft, positioned axially as it would latch into the corresponding sleeve according to FIG. 3*c;*

FIG. 9 is a cross-sectional view of the sleeve showing the pins latched into the locking slots, sectioned along line IX—IX of FIG. 7;

FIG. 10 is a cross-sectional view of the sleeve showing the pins latched into the release slots, prior to release, sectioned along line X—X of FIG. 5; and FIG. 11 is a cross-sectional view of the sleeve after the pins have been guided out of the release slots, sectioned along line XI—XI of FIG. 5.

DETAILED DESCRIPTION OF THE PREFERRED EMBODIMENT

Figure 1A:
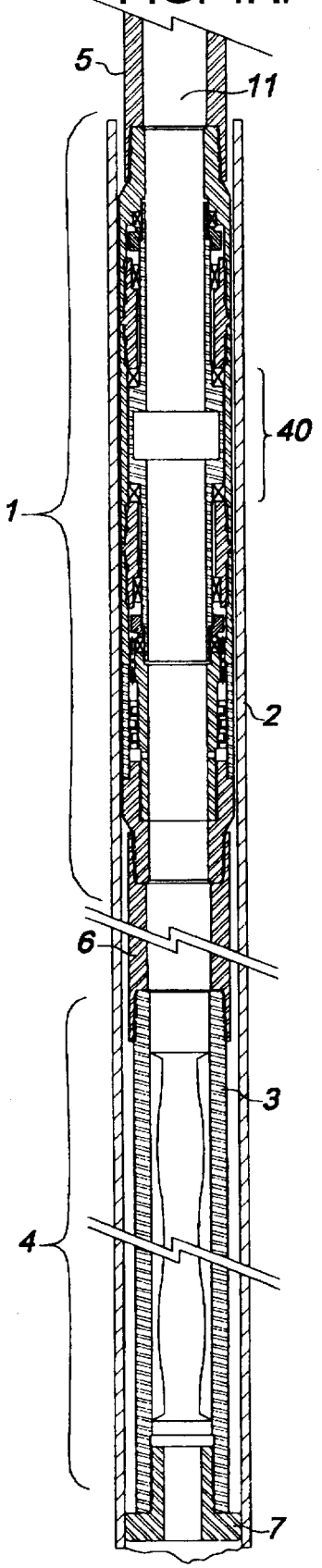
FIGS. 1*a* and 1*b* are cross-sectional, pre-assembly illustrations of the rotor placer according FIG. 2. More specifically.
Figure 2:
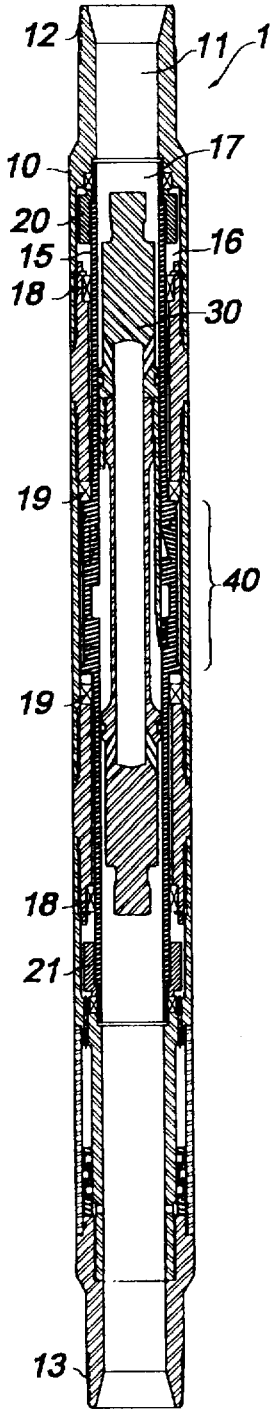
FIG. 2 is a cross-sectional view of the tubular housing, sleeve, bearing and driveshaft assembly according to the present invention.

Having reference to FIG. 2, an assembled rotor place 1 is shown. Turning to FIG. 1*a*, the rotor placer 1 is shown positioned in the lower portion of the well casing 2 of a completed oil well is shown. The stator 3 of a progressive cavity pump 4 is located concentrically within the well casing 2 and is suspended from a production string 5 by connection through the rotor place 1 and tubing joint 6. The pump stator 3 is secured against reactive torque rotation, relative to the well casing 2, using a no-turn tool 7 such as that described in U.S. Pat. No. 4,901,793, issued Feb. 20, 1990 to applicant.

Figure 1B:
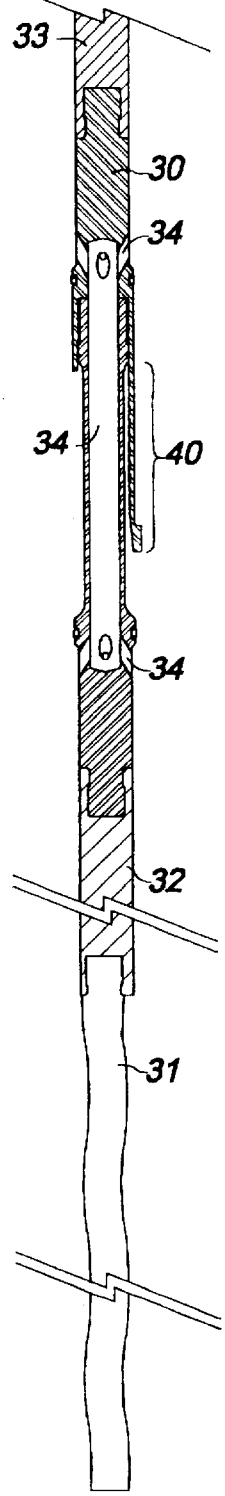

As shown in FIG. 1*b*, a driveshaft 30 is connected and distanced somewhat from the pump's rotor 31 using a discrete length of sucker rod 32. The driveshaft 30 is suspended from a sucker rod string 33. The driveshaft 30 and rotor 31 are lowered on the rod string 33. The lengths of tubing joint 6 and sucker rod 32 are such that when the rotor 31 engages the pump stator 3, the driveshaft aligns with the rotor placer 1.

Referring to FIGS. 2, 3*a*–3*d*, the rotor placer 1 comprises an outer tubular housing 10 having bore 11 (which is an extension of the bore of the production string 5) and threaded upper and lower ends 12, 13, for connection to the production string 5 and pump stator 3 respectively. Best seen in FIG. 3*a*, the tubular housing comprises tubular sub-sections 10*a*–10*f*, which enable assembly of the rotor placer 1. When assembled, intermediate the ends 12, 13 the housing forms a bore 14 which is larger in diameter than the bore of the production tubing 5.

A tubular sleeve 15 is fitted concentrically within the bore 14, forming an annular space 16 (FIG. 2) therebetween. The sleeve forms a bore 17 which is substantially (the same diameter as the bore 11 of the production tubing 5. Thus, the housing is assembled from sub-sections 10*a*–10*f* to enable installation of the sleeve 15.

The sleeve 15 is concentrically supported within the housing 10 using radial bearings 18 and thrust bearings 19 arranged within the annular space 16. Conventional shaft seals 20,21 isolate the bearings 18,19 from well fluids. FIGS. 2, 3*a* and 3*b* illustrate the corresponding positioned of the bearings, seals and sleeve. The bearings 18 permit free, concentric rotation of the sleeve 15 relative to the housing 10 and constrain it from relative axial movement.

Turning to FIG. 3*a*, housing sub-sections 10*a* and 10*b* enable installation of seal 20 and one thrust bearing 19. Housing sub-sections 10*d* and 10*e* enable installation of seal 21 and the other thrust bearing 19. Housing sub-section 10*c* enables installation of the sleeve 15 and the two radial bearings 18.

Housing sub sections 10*f* and 10*g* from an annular space 22. Passageways 23 connect the annular space 22 with the bearing annular space 16. Passageways 24 connect the annular space 22 with the bore 11 and the well fluids. Piston 25 and annular seals 26 move within the annular space 23 to equalize bore pressure with that around the bearings 18,19, thereby avoiding failure of the seals 20,21.

The assembled housing 10, bearings 18,19 and sleeve 15 are run into the well casing 2 as a unit with the production string 5.

As shown in FIGS. 1*b* and 3*d*, flow passageways 34 are formed in the driveshaft 30 for passing produced fluids from the pump 4, past the sleeve 15 and bearings 18,19 for delivery up the production string 5.

Latching means 40 releasably, concentrically and axially lock the driveshaft 30 to the sleeve 15, independent of vertical loading. Much like a ball-point pen retract/extend mechanism, two successive up-hole and down-hole movements of the driveshaft (by raising and lowering the rod string) will engage or disengage the driveshaft 30 from the sleeve 15.

More particularly, and having reference to FIGS. 3*c*, 3*d*, 4–11, the latching means 40 comprises cooperating elements formed in both the sleeve's bore 17 and the driveshaft 30. Annular recess 41 is formed in sleeve's inner wall 42, intermediate the sleeve's ends. As shown in the flat development of FIG. 4, an even number of circumferentially-spaced slots 43 are formed in the inner wall 42, extending axially up-hole from the annular recess 41 and radially outwards from the bore 17. The slots 43 from radial cam walls 44 which act to guide a plurality cam-following pins 45 which extend radially outwards from the driveshaft 30.

Each up-hole slot 43 comprises a substantially axial cam portion 46 and a helical cam portion 47. An equal number of helical cams walls 48 extend axially down-hole from the annular recess 41. Thus, the cam portions 48, 47 and 46 form a continuously and circumferentially advancing zig-zag path P for pins 45.

One-half as many pins 45 exist (three) as there are slots 43 (six) so that there is a pin for every alternate slot. Referring to FIG. 3*d*, extending from the driveshaft 30, each pin 45 is mounted at the up-hole end 51 of a generally axially-extending member 50 which is mounted at its down-hole end 52 to the driveshaft. The members 50 are flexible and spaced from the driveshaft 30 so as to enable limited radial movement of the pins 45, sufficient to enable the pins to be deflected radially inwards so as to fit inside the bore of the sleeve 15. The members 50 and pins 45 are biassed radially outwards so that they normally rest at a diameter larger than the sleeves bore 17 so as to engage recess 41 and slots 43.

Figures 4, 5, 6, 7:
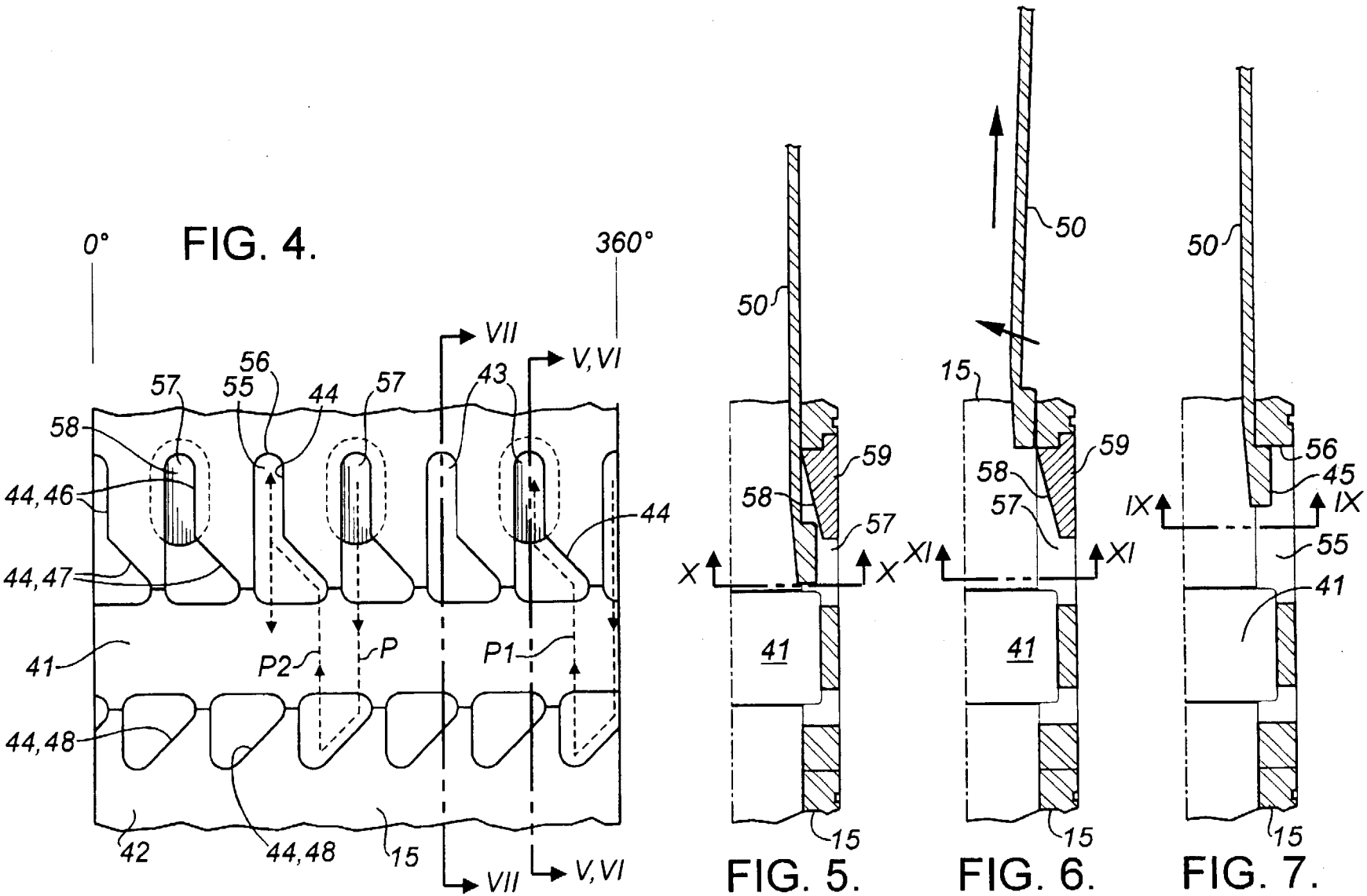
FIG. 4 is a flat development of that portion of the sleeve which incorporates slots of the driveshaft latching means.
FIG. 5 is a partial cross section of one of the release slots of the latching means, along line V—V of FIG. 4, with a latching pin shown prior to release.
FIG. 6 is a partial cross section of one of the release slots of the latching means, along line VI—VI of FIG. 4, with a latching pin fully released.
FIG. 7 is a partial cross section of one of the locking slots of the latching means, along line VII–VII of FIG. 4, with a latching pin locked against the slots end.
Figure 8:
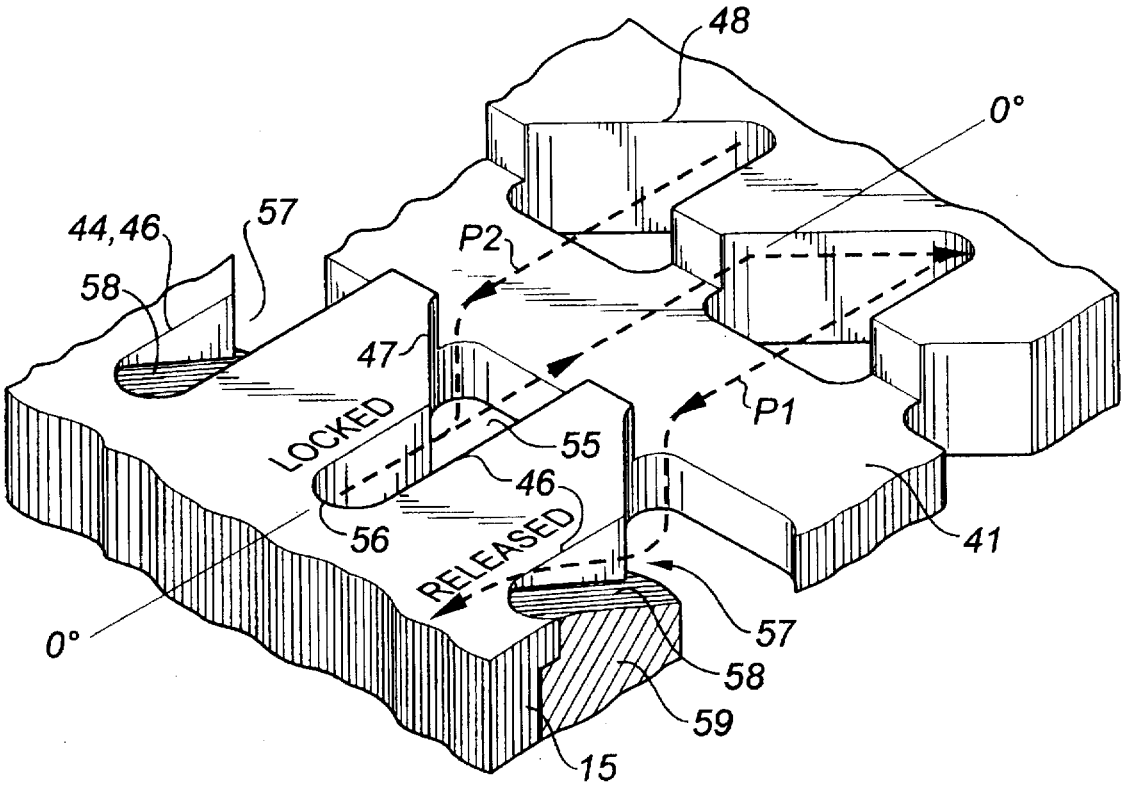
FIG. 8 is a partial, perspective view of a flat development of the slot latching means in the sleeve.

As the drive shaft 30 is inserted down-hole into the sleeve 15, the pins 45 and members 50 are be displaced radially inwards and drag along the bores 11,17 of the production tubing and sleeve (FIGS. 6 and 11). As shown in FIGS. 7 and 9, when pins 45 reach the annular recess 41, they snap radially outwardly and engage the slots 43. Thereafter, further movement of the driveshaft causes the pins 45 to move along either of paths P1 or P2, relative to the sleeve 15, guided by the slot's cam walls 44.

Referring to FIGS. 4–8, latching means 40 can be seen to have two operating positions; locked and released. In the first latched or locked position, for example along path P2, neither up-hole or down-hole force will disengage the driveshaft 30 from the sleeve 15. In the second released position, proper manipulation of the relative positions of the driveshaft and sleeve (along path P2) cause the pins 45 to disengage substantially freely from the sleeve 15.

More specifically, as the driveshaft 30 is manipulated up-hole, the helical cam walls 47 cause the pins and sleeve to rotate relative to each other at about 45 degrees, guiding the pins 45 along zig-zag path P into one of two possible axial slot configurations; locked (path P1) or released (path P2).

The up-hole ends of first slots 55 have lateral end walls 56. In the locked position, upon reaching wall 56, the pin 45 bears squarely against this wall arresting any further relative axial movement of the driveshaft 30 and sleeve 15. In other words in the pins 45 are locked within the slot 55 regardless of the axial load imposed on the driveshaft 30.

The up-hole ends of the alternate or second slots 57 incorporate a radial ramp 58. Ramp 58 is formed by wedge-shaped insert 59 placed into slot 55. In the released position, upon reaching ramp 58 (FIG. 10), the inclined surface of ramp 58 guides the pin 45 radially inwards, disengaging the pin from the slot 57 (FIG. 11) and releasing the driveshaft 30 from the sleeve's recess 41.

As the driveshaft 30 is manipulated down-hole, the helical cam walls 48 relatively rotate the pins at about 45 degrees, guiding the pins 45 into circumferential alignment with the next slot 55 or 57.

Upon first assembly of driveshaft 30 into sleeve 15, their is an equal opportunity that the pins 45 will initially engage an locking slot 55 or releasing slot 57. To position the driveshaft 30 in the sleeve 15, the following procedure is followed:

- lower the rod string 33, driveshaft 20 and rotor 31 to a position just above the tubular housing 10. Record the rod string weight;
- lower again until the rod string weight decreases by 5000 lbs., indicating latching of the pins 45 into the recess 41 or the latching means 40 (pins bearing against cam wall 48);
- pull on the rod string 33 until the weight is about 3000 lbs. greater than the free rod weight (pins bearing against slot end wall 56); but
- if the rod weight does not increase then that signifies that the pins 45 had instead engaged the releasing slots 57 and pulled free of the latching means 40. The above must be repeated as required to engage the latching means with the pins 45 in a locking slot 55.

To release the driveshaft 30 from the sleeve 15, the following procedure is followed:

- lower the rod string 33 until the rod string weight decreases by 5000 lbs., so that the driveshaft's pin 45 engage the down-hole helical cams 48 and rotate the pins 45 relative to the sleeve 15, indexing the pins 45 to the next slot 55 or 57;
- pull on the rod string 33 until the load is more than the free rod string weight; and
- if the rod string 33 does not lift free of the rotor placer 1, then the latching means pins 45 were indexed to the locked position and the above must be repeated to index the pins 45 and sleeve 15 to the release position.

As a result of the improved means for latching the driveshaft to the tubular housing and by arranging the stabilizing bearings as an assembly within the tubular housing, bearings can have a generous diameter, greater than that of the production tubing, resulting in longer service life.

What is claimed is:

1. An improved rotor placer located within an oil well in which a sucker rod string extends down the bore of production tubing and is drivably connected to the rotor of a progressive cavity pump, the stator which is connected to the bottom of the production string, and in which a tubular housing is connected between the production string and stator, a driveshaft installable within the housing and connected between the rod string and the rotor, and bearings interposed between the driveshaft and housing for concentrically and axially stabilizing the rod string, the improvement comprising:

- a sleeve having a cylindrical wall and forming a bore for accepting the driveshaft, the axial length of the sleeve being shorter than the tubular housing,
- a tubular housing assembled from at least two parts and having radially distended walls for forming a bore intermediate its ends which is large enough in diameter to accept the sleeve positioned concentrically therein and forming an annular space therebetween;

bearing means located in the annular space for concentrically, axially and rotatably positioning the sleeve;

means for connecting the housing parts once the bearings and sleeves have been installed therein;

passageways formed in the driveshaft for conducting fluids past the bearings means and on up to the production tubing;

means for releasably latching the driveshaft and sleeve together so that the sleeve is locked concentrically and axially to the driveshaft.

2. The improvement as recited in claim 1 further comprising seal means positioned adjacent either end of the annular space for isolating the bearings from well fluid.

3. The improvement as recited in claim 2 further comprising means for equalizing the pressure between the well fluid and the seal means.

4. The improvement as recited in claim 3 wherein the latching means comprises:

a plurality of parallel and axially extending slots formed in the wall of the bore of the sleeve;

a plurality of slot-following pins, extending radially from the driveshaft and movable between a radially inward bore-clearing position and a radially outward slot-engaging position, the number of pins being one-half that of the slots and arranged to engage only every alternate slot;

means associated with the down-hole end of the slots for relatively guiding the pins from one slot to the adjacent slot in a progressively circumferential manner and preventing the pins from disengaging from the slots;

means associated with the up-hole end of every second slot for arresting up-hole axial travel of the pins in those slots and thereby locking the pin in the slot; and means associated with the up-hole end of the alternate slots for displacing the pins radially inwards and thereby disengaging the pins from the slots so that the driveshaft is released from the sleeve.

5. The improvement as recited in claim 4 wherein slots comprise:

an annular recess formed into the wall of the bore of the sleeve, positioned intermediate along its bore;

two sets of equal numbers of parallel slots which are formed in the sleeve's wall spaced circumferentially and equally about the bore of the sleeve, each slot extending axially up-hole from the recess, the up-hole end of the first set of slots having a radial end wall which acts to arrest up-hole axial movement of the pins relative to the sleeve wherein the driveshaft is concentrically locked within the sleeve, the second set of slots having a depth which diminishes to extinction at the bore as the slot progresses up-hole for displacing the pins radially inward upon axial up-hole movement of the pins; and radial walls located at the down-hole end of the slots for causing relative rotational movement of the pin and sleeve so as to continuously index the pin from one set of slots to next adjacent set of slots as the driveshaft and sleeve the moved axially relative to each other.

* * * * *